US005448477A

United States Patent [19]

Delatorre et al.

[11] Patent Number: 5,448,477

[45] Date of Patent: Sep. 5, 1995

[54] SYSTEMS FOR INPUT AND OUTPUT OF DATA TO A WELL TOOL

[75] Inventors: Leroy C. Delatorre, Sugar Land, Tex.; René Pingenot, Springfield, Mo.

[73] Assignee: Panex Corporation, Sugar Land, Tex.

[21] Appl. No.: 20,393

[22] Filed: Feb. 22, 1993

[51] Int. Cl.[6] ..... G06F 19/00; G06G 7/00

[52] U.S. Cl. ..... 364/422; 364/550; 364/569; 250/256; 324/333; 455/6.3; 340/310.06; 340/870.39

[58] Field of Search ..... 364/420, 422, 550, 569, 364/464.04; 455/6.1, 6.3; 250/256, 265, 266; 324/323, 333; 340/310 R, 310 A

[56] References Cited

U.S. PATENT DOCUMENTS 4,033,186 7/1977 Bresie ..... 73/154
4,161,782 7/1979 McCracken ..... 73/154
4,622,640 11/1986 Shimamura et al. ..... 364/464.04
4,624,136 11/1986 Delatorre et al. .
4,763,259 8/1988 Delatorre et al. ..... 364/422
4,817,044 3/1989 Ogren ..... 364/550

*Primary Examiner*—Robert A. Weinhardt
*Assistant Examiner*—Jennifer L. Hazard
*Attorney, Agent, or Firm*—Donald H. Fidler

[57] ABSTRACT

System for the input and output of data on a two wire system with a downhole well tool which has a system with sensor devices, a processor, a clock, a memory and a voltage/current communications device which are all powered by a d.c. battery. A phone jack and phone plug connection at the earth's surface enables an operator with a controller to input and output data to the well tool without disassembly and enables setting the clock in the well tool to a selected real time value. This enables synchronization of real time values of data recordings for different tools.

21 Claims, 4 Drawing Sheets

SYSTEMS FOR INPUT AND OUTPUT OF DATA TO A WELL TOOL

FIELD OF THE INVENTION

This invention relates to oil field tools, and more particularly to the input and the output of data for downhole battery operated tools on a real time basis where the data can be synchronized on a real time basis to operate separate tools in thee same trip in the well bore and where input and output data can be applied to a well tool by communication through a battery pack in the tool.

BACKGROUND OF THE INVENTION

In oil well operations, self contained downhole tools on a wire line and powered by a D. C. battery pack are used for measuring pressure and temperature, and for obtaining and storing such pressure and temperature data in a memory on a real time basis. Other tools such as flow meters and gamma ray tools are also run on wire line and take measurements data in a battery operated tool where the measurements data are recorded in a memory on a real time basis. The data is collected over a period of time and correlated to a real time clock in the well tool. Such data provides significant information from which the production, production life and hydrocarbon reserves available can be estimated.

In some instances it is necessary or desirable to retrieve a well tool and output the collected data for analysis and to rerun the tool in the well bore to gather more data or operate under a different set of collection instructions which are input to the tool. One of the inherent problems of this situation is that it is necessary to disconnect the D.C. battery pack from the well tool which disables the real time clock so that the second run data obtained in the well bore may not be correlatable to the first run data on a real time basis. Another and perhaps more significant problem is the lack of accurate synchronization of the data on a real time basis with other tools.

Relevant prior patent art includes the following patents and the cited patents therein:

U.S. Pat. No. 4,033,186 issued 7/05/77 to Bresie

U.S. Pat. No. 4,161,782 issued 7/17/79 to McCracken

U.S. Pat. No. 4,763,259 issued 8/09/88 to Delatorre

U.S. Pat. No. 4,624,136 issued 11/25/86 to Delatorre

In the U.S. Pat. No. 4,763,259, the well tool therein is compartmentalized and the electronics for the system can be checked prior to operation by use of a voltage/-current system. After collecting downhole data, the data can be output using the current/voltage system and new data instructions can be installed in the tool central processing unit (CPU). The system, however, requires either the battery pack or the sensors to be disconnected for data transmission. When the battery pack is disconnected, real time continuity in the internal CPU is lost and when the sensors are disconnected, there is no way to verify proper sensor operation or confirm proper connection when reconnection is made. Also, there is no way of determining after re-assembly if the sensors are functioning.

In seeking accuracy of the measurement data where more than one run of a tool is desired, it is preferable to not disturb any components of the system which might alter their response to measurement in the second run.

THE PRESENT INVENTION

The present invention is incorporated in a self contained battery operated downhole well tool for use in oil field production. The system provides for the input and/or the output of data to a battery operated CPU and memory in a pressure and temperature measuring tool without removing the battery pack or sensors in the tool and provides for the synchronization of real time measurements by several independent tools.

In the present invention, the tool has an internal CPU and memory which records data measurements from pressure and temperature sensors in the tool on a real time basis with respect to a clock operation which can be initiated at the commencement of the measurement operations by an external clock source in an external or host CPU. The data measurements are made below a preselected or predetermined voltage control level of the system. Other tools that record data measurements on a real time basis include flow meters and gamma ray tools.

In the well tool, input or output of data to the internal CPU is through a two wire voltage/current communication system. The voltage/current communication system is conditioned for communications with an external independent controller device by raising the operating voltage in the tool above the preselected voltage control level to place the system in a communication mode. The communication mode is at a level of operational voltage where the instruction data is input in a binary digital format to the internal CPU from the controller device. In the communication mode, the internal CPU can use voltage/current system to transmit data in a binary digital format from the internal CPU to the CPU in the external controller device. The battery pack for the internal tool CPU and the downhole electronics in the well tool is a D.C. system where the metal housing of the tool is utilized for an electrical common ground.

In the present invention, the negative or ground terminal of the battery pack is connected to a conventional phone jack to provide a ground circuit through the mechanical switch contacts of the phone jack to the tool housing. The phone jack is in a sub or housing at the upper end of the housing containing the batteries. The upper end of the housing is sealingly coupled to a connector housing which serves to connect the tool to a wire line.

When it is desired to input or output data to or from the, internal CPU in the well tool, the connector housing is removed and a two conductor phone plug from a controller is inserted into the phone jack. The phone plug has two connector wires which connect to an external controller. The external controller provides an independent power source with a voltage/current communication system. This system includes an adjustable voltage regulator for control of the voltage to the internal CPU and input of digital instructions to the internal CPU, a current sensing circuit for detection of output digital data from the internal CPU, a CPU, a clock, a voltage measuring device and a switching system.

The controller is operated by a program memory card and a keyboard input and provides a visual information display. In operation, when the controller is connected to the internal CPU by the phone plug, and while the internal battery pack is in the tool, battery voltage of the battery pack is ascertained and the internal CPU is conditioned for communications by raising the operating voltage to the preselected communication voltage level for the communications mode. Thereafter, the external CPU in the controller can reprogram the internal CPU and/or data can be retrieved from the memory in the tool and the clock value in the tool can be reset to a clock value as determined by the clock in the controller.

The controller CPU is provided with program instructions for the desired operations of the well tool. The controller transfers the program instructions to the internal CPU and the operation is based on a real time basis as established from the clock in the controller CPU.

Upon activating or "start", of the controller, the controller CPU determines the internal battery voltage of the battery pack in the well tool and sets its adjustable voltage regulator so the sum of the battery voltage and the regulator voltage is equal to a preselected communication voltage level to initiate the communication mode between the controller CPU and the tool CPU. The controller CPU operates the switching system to properly connect the tool CPU and system to the controller without removing the battery pack from the tool CPU. Instruction data can be transmitted in digital voltage pulses from the controller CPU to thee internal tool CPU of the well tool. To read out data from the tool, the controller CPU reads out data from the tool CPU by a current sensor and the data is recorded on a memory card in the external controller.

In combination with oil tools such as a flowmeter and/or gamma ray detector, each of these tools is provided with a CPU battery pack and voltage/current sensing system where the battery pack is connected to a phone jack sub. With this arrangement, before running in the well bore, each of the tools can be set to the same real time clock in the external computer before assembly and insertion in a well bore. This then synchronizes the data from each of the well tools on the same real time basis.

DESCRIPTION OF THE INVENTION

Figure 1:
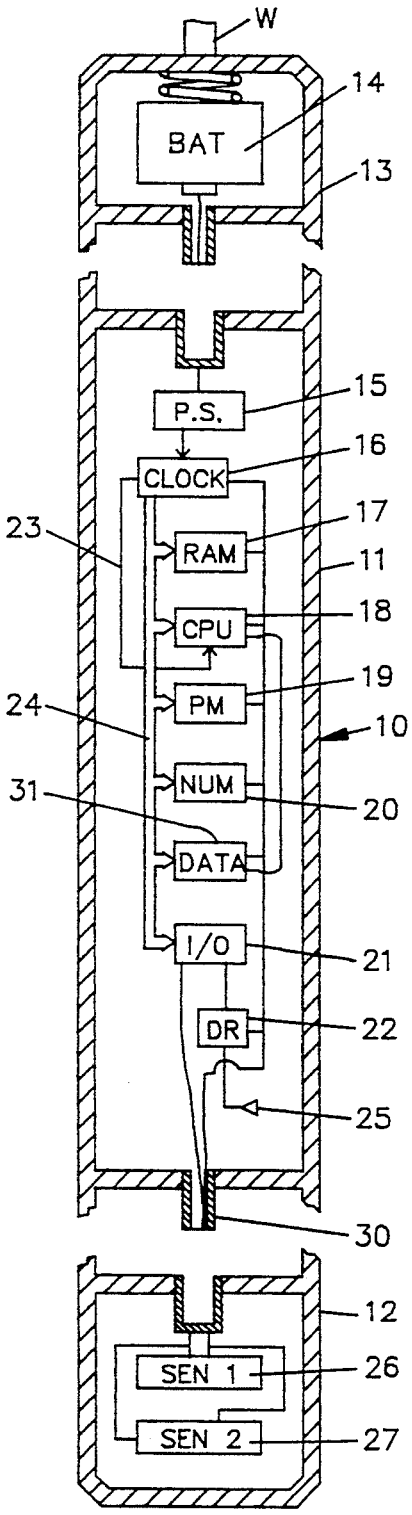
PRIOR ART FIG. 1
FIG. 1 is a schematic illustration of a well tool system disclosed in the prior art for an understanding the background for the application of the invention.

Referring now to FIG. 1, the prior art system disclosed in U.S. Pat. No. 4,763,259 is illustrated for purposes of understanding the application of the pre, sent invention. In FIG. 1, the downhole tool 10 is suitable for use in a production well for measuring temperature and pressure in the well bore over a period of time. The tool 10 includes three separate pressure and liquid tight housing an electronics systems housing 11, a sensor housing 12, and a battery pack housing 13 which is also a connecting head. The tool is typically sized for passage through a small diameter production tubing by means of a wireline W and the connecting head 13 which contains the D.C. battery pack 14. The battery pack 14 typically consists of a number of end to end arranged dry cell batteries. The head 13 and electronic housing 11 are independently sealed and when interconnected, the battery pack 14 has a positive terminal electrically coupled to the electrical processing circuits within the housing 11 and a negative terminal connected to the housing 14 for an electrical ground which is a ground for the entire tool when the housings are assembled. By separately housing the battery pack 14 and the electrical processing circuits in the housing 11, the processing circuits are never exposed to the field environments.

In the electronic systems housing 11 is a power supply 15 which supplies electrical power to an electronic clock or timer means 16. The clock 16 is an electronic device which functions over a period of time to periodically control the application of power to the downhole processing equipment in accordance with a preselected set of preinstalled software recording instructions. Each recording instruction enables the measuring and memory circuits in the tool to operate for a time period as determined by the number of samples to be obtained and to be turned off for discrete time intervals as determined by the sample rate until the completion of the test. The time periods and time intervals can be independently set for a range or number of the program instructions. The program instructions are used where each program recording instruction establishes a time sequence for sampling a predetermined number of pressure and temperature data samples and the time interval or sampling rate taking of samples.

The clock 16 controls the application of power to the system. When the clock connects the power supply enables operating power to be applied to a random access memory (RAM) circuit means 17, a central processing unit (CPU) circuit means 18, a program non-volatile memory (PM) circuit means 19, a non-volatile data (EPROM) circuit means 20, an input-output (I/O) circuit means 21, and a driver circuit means 22. The clock means 16, by a connection 23, resets the CPU 18 each time the CPU is turned on. The clock 16, the RAM 17, the CPU 18, the program memory 19, and the I/O 21 are all interconnected by a data bus 24 which interrelates the programmed functions and data transfer for the various units.

An audible acoustic device 25 is connected to the driver circuit 22. As will be apparent, hereinafter, the present invention eliminates the need for the acoustic device 25. A first sensor 26, such as a pressure sensor and a second sensor 27, such as a temperature sensor are coupled to the I/O circuit 21 by a connector 30 and the signal data from the sensors is in a digital format or converted to a digital format.

In operation of the system, the clock means 16 controls the period of time that the various units are turned off. The clock means 16 is operated by the recording program instructions which are input to the CPU 18 at the earth's surface prior to running the tool. The recording program instructions are a series of commands to operate software to control the operation of the equipment for a discrete number of sampling periods and to set the time intervals between each sampling period. In each sampling period of an instruction, samples for each of the temperature and pressure data are obtained and the number of samples of each data sample is established by the instruction. The recording program instructions thus serve to direct the operating functions of the CPU to obtain data samples. A flow chart for the recording program instructions and further explanation of the system is shown in FIGS. 2A, 2C of U.S. Pat. No. 4,763,259 and is incorporated herein.

The well tool as described in U.S. Pat. No. 4,763,259 and illustrated in FIG. 1 has a voltage/current data communication system 31 to input and output data to the tool CPU from a external host CPU which is connected to the data communication system 31 after the sensor housing 12 is removed. In this process, the removal and reattachment of the sensor housing 12 can result in uncertainty as whether the system is operable when reassembled. To remove the battery housing 13 stops the real time clock for the system since the power is removed.

Figure 2:
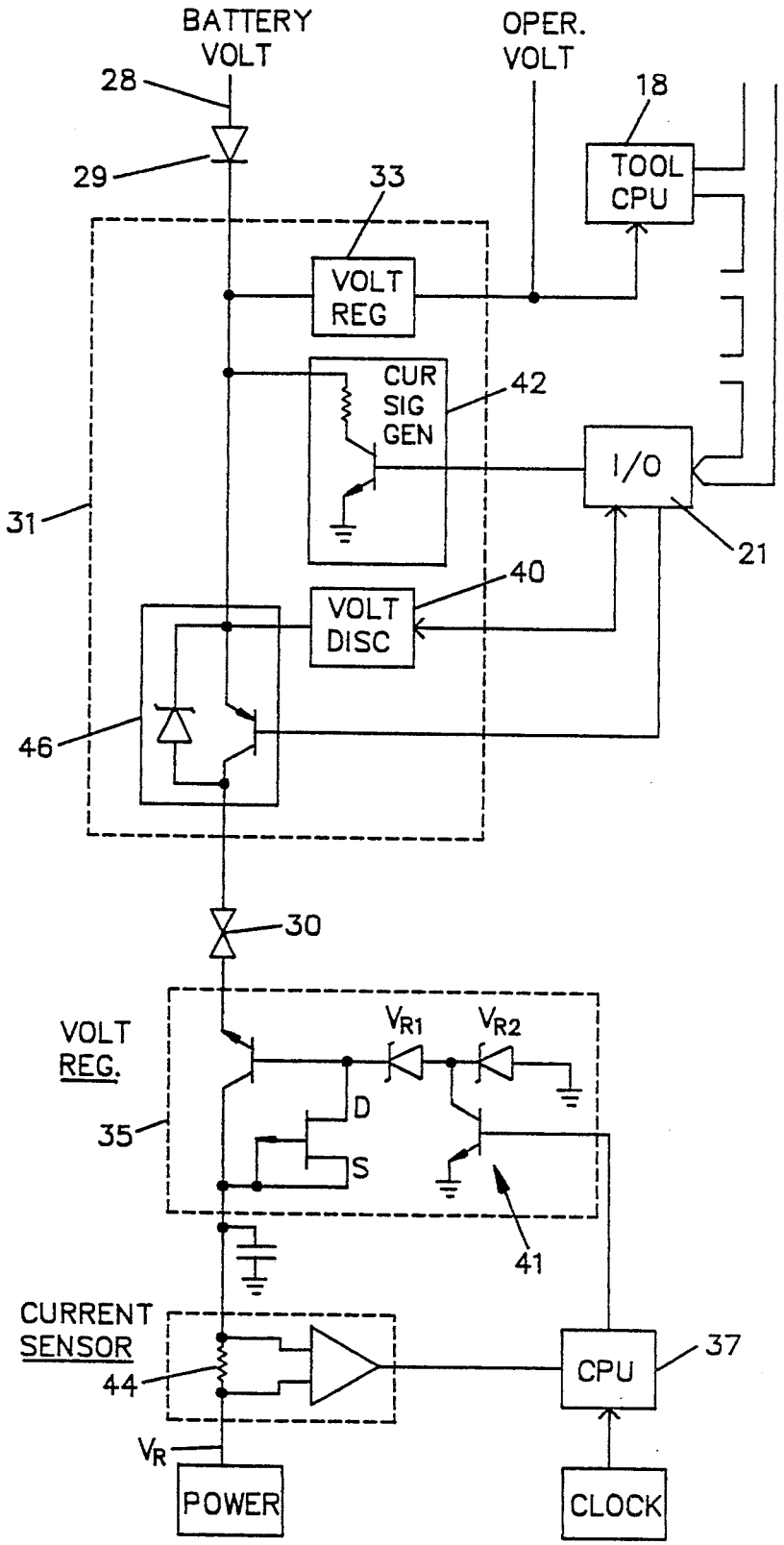
PRIOR ART FIG. 2
FIG. 2 is an electronic schematic illustration of the communications system disclosed in the prior art which is suitable for input and collection of data to and from the internal CPU processing equipment.

Referring now to FIG. 2, the system for input and collection of data instructions from the memory in the processing equipment of the well tool of FIG. 1 is schematically illustrated. As shown in FIG. 2, the tool CPU 18 is normally powered by a battery voltage received on line 28 via a blocking diode 29 to a voltage regulator 33 which supplies a regulated voltage to the CPU 18 and to the remainder of the electrical systems.

In the prior art system shown in FIGS. 1 and 2, to input or output data, the sensor housing 12 is disconnected from the housing 11 to provide access to the connector 30. In the tool 10, the data communication or interface circuit 31 is interconnected between the input/output circuit 21 and the CPU 18. The data communication circuit 31 has a first voltage regulator 33 (See FIG. 2) which receives the voltage above the level of operational voltage and applies a constant operating voltage to the CPU 18 and, as necessary to the other circuits. The constant voltage regulator 33 is supplied voltage via the connector 30 from an externally located voltage regulator 35. The voltage regulator 35 is supplied from a source of voltage $V_r$ which is above the level of the operational voltage. Thus, the voltage $V_r$ provides an operating voltage to the system independent of the battery source.

To place the tool CPU 18 in communication with the host CPU 37, a voltage discriminator circuit 40 is coupled to the I/O circuit 21. The external voltage regulator 35 (which is set to the voltage necessary to initiate the communication mode) has a switch means 41 which develops a voltage output $V_r$ or $V_{r1}$ in the voltage regulator 35. The switch means 41 is operated by the host CPU 37 to encode a binary voltage input code by modulating the voltage to the levels $V_r$ and $V_{r1}$ in the voltage regulator 35 which is detected by the voltage discriminator 40 in the tool. The battery voltage 28 is not necessary for the operation.

The binary voltage input code which is input by voltage pulses representing digital 0 and 1 by program input into the CPU 37 and the program memory, the software instruction programs and the operating program are input to the tool CPU 18. Thus, the programs are placed in the tool in a non-volatile memory which will retain the programs independent of power applied to the CPU 18.

During the input of the programs, or at the completion of the input of the software, the host CPU 37 executes a verify step which directs the CPU 18 to play back the input programs to the host CPU 37. This is accomplished by encoding the programs as a binary current code. The binary current code is obtained by a transistor circuit 42 which acts as current switch to provide the pulse code from the I/O circuit 21. Externally of the tool, a load resistor 44 detects the current changes (which are in binary code) and inputs the current code to the host computer 37 for a read-out of the program or verification of the data.

After input of the program instructions, the tool is ready for the surface test and subsequent collection of data downhole. After collecting the data, in a downhole survey, at the surface, the tool is again connected to the host CPU 37, where the current code is used to output the collected data in the memory to the host CPU 37 for recording and analysis or to input new instructions.

In the present invention, the current/voltage communication system and the external CPU are utilized in a simple manner by removing only a connector head while leaving the battery pack, the electronics and the sensors intact and undisturbed. A current/voltage communication system is incorporated into a controller which has a phone plug connection to a phone jack in the tool and can input and output data to the CPU in the tool without disconnecting the battery pack or the sensor unit.

Figure 3:
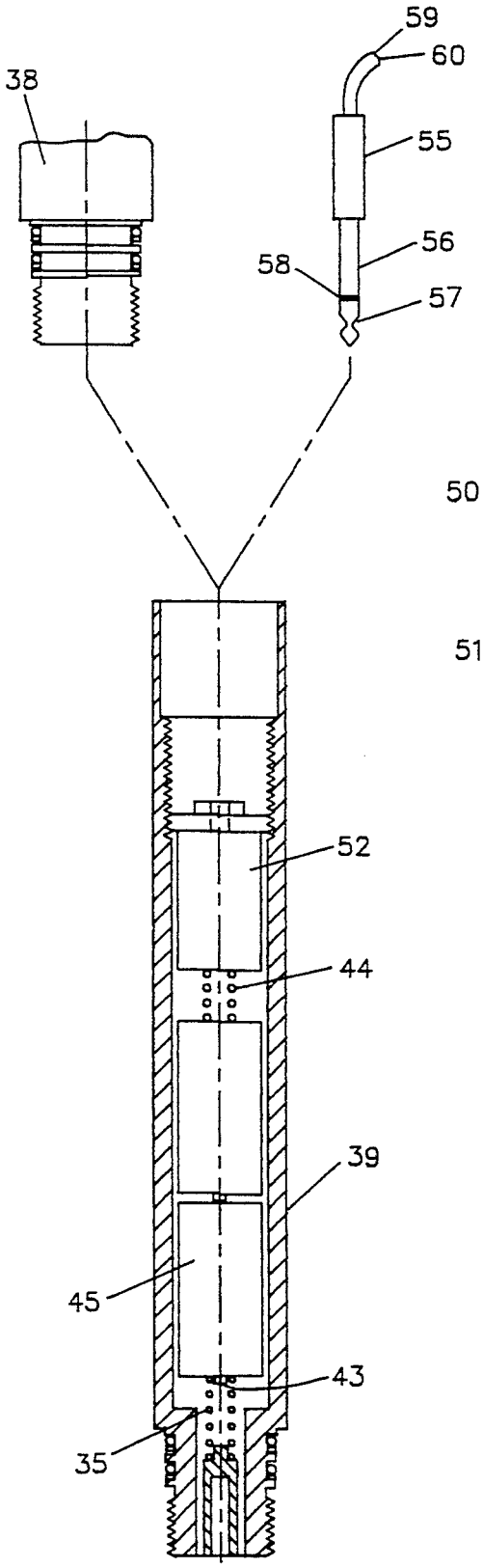
FIG. 3 is a view in partial cross-section illustrating the battery and phone jack sub used in the present invention.

Referring now to FIG. 3, in the present invention the battery sub or housing 39 is modified to be a metal tubular member with threaded ends for adapting its sealed connections to a connector head and tool housing. The lower end of the housing 39 is connected to the tool housing which provides a common electrical ground for the well tool. The sub 39 has an upper threaded end which is connectable to a wire line connector head 38. As illustrated, the head 38 can be removed from sealing connection with the sub 39. In the hollow interior of the sub 39 are a number of in-line D.C. dry cell batteries 36 which are series connected with a positive terminal 43 connectable to the power supply of the well tool. A coiled spring 35 in abutting engagement with an end battery 45 of the linear array of batteries is utilized to maintain the batteries in the battery pack in contact with one another.

Figure 4:
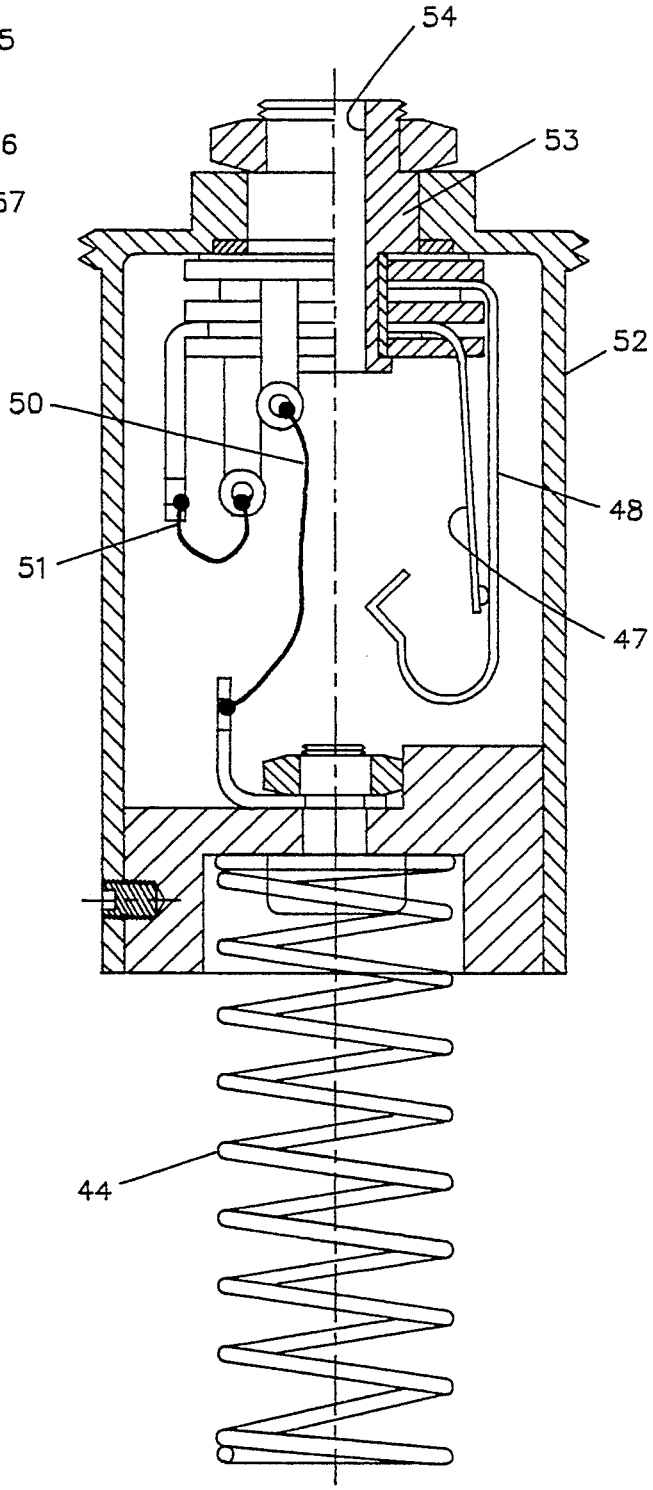
FIG. 4 is an enlarged view in partial cross-sections of a phone jack arrangement in the present invention.

At the upper end of the battery pack is a phone jack 52 which is mounted in the internally threaded upper end of the sub 39. The phone jack 52, as shown in FIG. 4, is a conventional item which has spring contact members 47, 48 normally in contact with one another. The contact 48 is electrically connected to a conductor 50 which, in turn connects to the negative pole of the battery pack.

The contact 47 is electrically connected to a conductor 51 which, connects to an inner tubular metal member 53 with a central bore 54 in the jack 52. The tubular member 53 is also electrically grounded on the housing sub 39. The contact 48 and the contact 47 when in engaging with one another connect the negative pole of the battery pack to the housing of the sub 39 as the common electrical ground.

As shown in FIG. 3, a phone plug 55 has two electrodes 56, 57 which are separated from one another by insulation 58 and are connected to separate leads 59, 60. When the phone plug 55 is inserted into the bore 54 of the phone jack 52, the electrode 57 engages contact 47 and mechanically opens the contacts 47 and 48 breaking the electrical continuity and connecting the electrode 57 (and conductor 59) to the conductor 50 and the negative terminal of the battery pack. At the same time the electrode 56 contacts the bore 54 of the phone jack 52 so that the conductor 60 is connected to the electrical ground of the housing sub 39.

Figure 5:
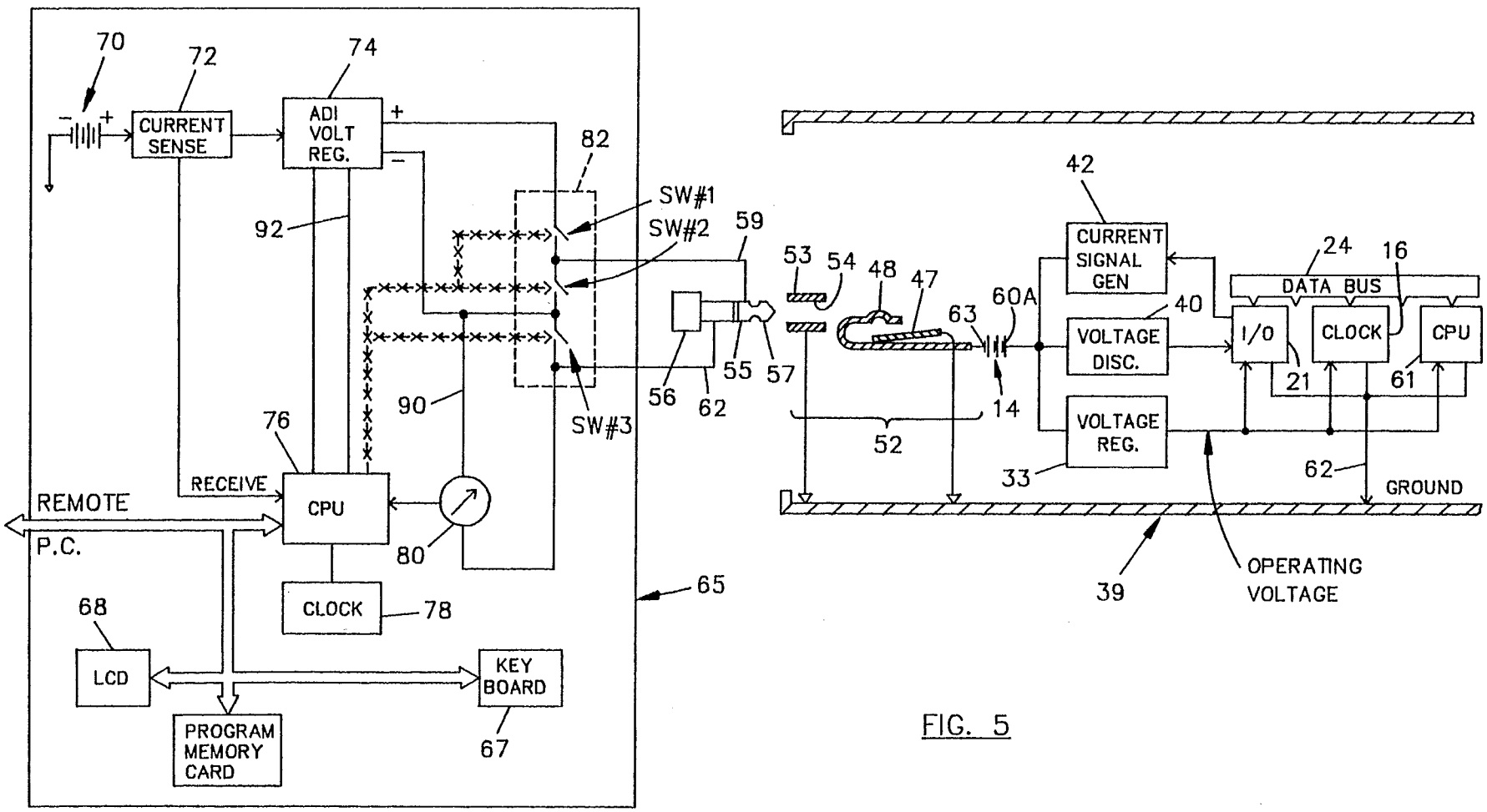
FIG. 5 is an electronic schematic illustration of the present invention as applied to a pressure and temperature measuring tool.

Referring now to FIG. 5, The housing sub 39 is illustrated with a battery pack 14 where a positive terminal 60A provides voltage for a current signal generator 42, the voltage discriminator 40 and the voltage regulator 33. The voltage regulator 33 furnishes voltage to the CPU 61 and other circuits and returns to the electrically grounded housing 39 as schematically shown by the line 62. The voltage discriminator 40 transmits input voltage pulse codes or instruction data to the CPU 61. The CPU 61 transmits data from the memory by current signal generator 42. The data collection system is arranged to operate with 20 volts or less and a voltage range of 22.5 to 30 volts is used for the communication mode.

Figure 6:
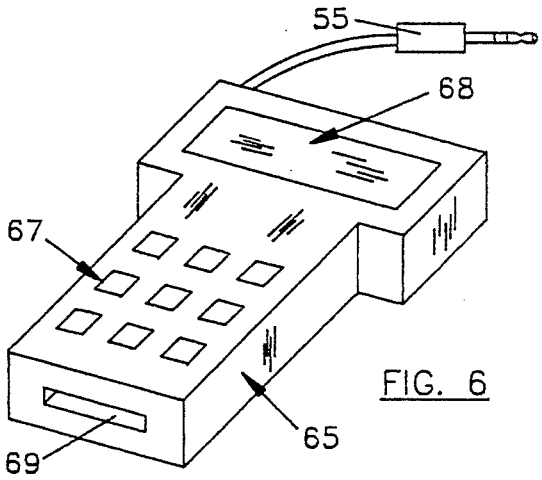
FIG. 6 is a perspective view of a typical external controller according to the present invention.

An external control device or controller 65 is shown in FIG. 6 and can be a hand held controller with a keyboard 67, and L.C.D display 68 and has a program memory card slot 69 to receive a memory card. In the controller 65, as shown in FIG. 5 are batteries 70 for power, a current sensing circuit 72, an adjustable voltage regulator 74, a CPU 76, a clock 78, a battery voltage meter 80 and a switching means 82. In the switching means 82 are three serially connected switches SW #1, SW #2, and SW #3, which are single pole single throw electronic switches which are controlled by the CPU 76.

When the phone plug 55 is inserted into the phone jack 52, the negative terminal 63 of the battery pack 14 is connected to the phone plug contact 57 and the conductor 59 of the phone plug 55. The tubular housing 53 of the phone jack which is at electrical ground for the system is connected to the conductor 60 of the phone plug 55. The mechanical switch contacts 47 and 48 are opened disconnecting the negative terminal 63 of the battery pack 14 from the housing 39.

In the initial condition of the switching means 82 of the controller 65, the switch #1 is open while switch #2 and the switch #3 are closed. Switch #1 is open to prevent the adjustable voltage regulator 74 in the controller from shorting to ground. With closed switches #2 and #3, the phone plug 55 connects the conductor 62 (battery ground) via switches #2 and #3 to the conductor 59 and the negative terminal of the battery 14.

Data communications are initiated by activating the external CPU 76 in the controller 65. Upon activating the controller CPU, the switch #3 is opened. The negative terminal 63 of the battery 14 is then connected to a voltage meter 80 by a conductor 90 while the positive terminal 60 of the battery 14 is connected to the voltage meter 80 through the voltage regulator 33 and the CPU 61 because the impedance of the CPU 61 and other circuit is much less than the impedance of the voltage meter 80 so the positive voltage of the battery pack 14 is essentially applied to the meter 80 and also supplied as a data input to the CPU 76 that may also be displayed on the L.C.D. 68 as shown in FIG. 6. If the battery pack 14 is not connected, a voltage of zero will be read by the meter 80.

The external CPU 76 of the controller then sets the output of the adjustable voltage regulator 74 to the communications voltage level (approximately 26 volts) minus the battery voltage of battery pack 14. This CPU control instruction sent via a conductor 92 sequentially opens the switch #2 to disconnect the negative terminal 63 of the battery 14 from the housing ground and closes the switch #1 to apply the voltage of the voltage regulator 74 to the negative terminal 63 of the battery 14. The voltage meter 80 again measures the voltage at the positive battery terminal 60. This time the voltage read by the CPU 76 in the controller is the battery voltage of battery 14 plus the regulated voltage from the voltage regulator 74. If it is not close to 26 volts, the CPU 76 adjusts the voltage of the voltage regulator 74 until it is. When the regulated voltage level of the adjustable voltage regulator 74 reaches 26 volts, the switch #3 is closed to apply the regulated voltage of 26 volts to the CPU 61 in the tool.

The CPU 76 of the controller is used send data instructions to the CPU 61 using a voltage binary transmit signal generated by the adjustable voltage regulator 74. Modulating the transmit signal between a logic "0" and a logic "1" causes the,, adjustable voltage regulator 74 to modulate the voltage applied to the CPU 61.

When an instruction causes the CPU 61 to transmit data from its memory, the current signal generator 42 in the tool is modulated to produce current signals between a logic "O" and a logic "1". The current signals are sensed in the controller 65 by the current sensing circuit 72 and are transmitted as data to the CPU and its memory.

In operation, the operator assembles the entire tool of the sensors, electronics and battery pack. Then, before attaching the connector head, the controller phone plug is plugged into the phone jack. When the "start" command is initiated in the controller 65, the controller 65 checks the battery voltage of the battery pack 14. If the battery voltage is correct the operator knows that the battery pack are functioning and the tool operation can be checked out by a data instruction program sent by the controller to the tool CPU for execution. After the tool is checked out functionally, the operator sends data instructions to the CPU on the sampling or tests to be conducted downhole and sets the clock 16 in the tool. The tool is assembled and run in the hole for the testing operation (which may be over an extended period of time such as days or more).

When the tool is retrieved, the connector head is removed and the phone plug of the controller plugged into the phone jack. As described above, this operation will not disturb the continuity of the operating battery voltage to the system. The controller checks the battery voltage and places the tool CPU 61 in a communications mode where instructions can be entered by the operation of the voltage regulator 74. At this point, the battery voltage has been interrupted. The tool CPU 61 can then respond with output of the logged data of the measured parameters in the well bore by operation of the current signal generator 42. The controller then decodes the transmitted data by operation of the current sensing circuit 72 and displays the data in the L.C.D. 68 and records the data in the proper memory card. Remote control or collection of data also can be made by a use of a compatible P.C. The clock 16 is automatically reset with the clock 78 in the controller. By use of the controller and the program memory card the operator need only understand which buttons to push since the testing program can be designed and installed on a program memory card by an engineer at a remote location.

Figure 7:
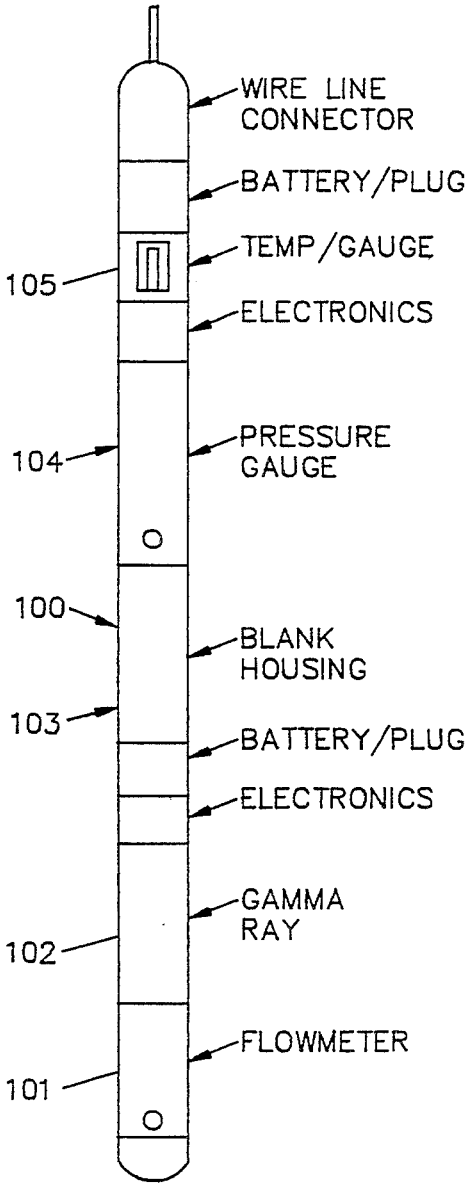
FIG. 7 is a view of a well tool schematically illustrating independent battery operated memory tools which can be synchronized on a real time basis in accordance with the invention.

Referring now to FIG. 7, a well tool assembly 100 can include a flowmeter 101, a gamma ray tool 102, blank or connecting housings for spacing if desired, a pressure gauge 104 and temperature gauge 105. The flowmeter 101 and gamma ray tool 102 can be coupled together as a unit and provided with a common electronics system and phone jack as shown in FIG. 5 where the I/O is connected to the flowmeter and gamma ray sensor respectively. It can then be appreciated that with the disclosed system of FIGS. 5 and 6, the tools can be programmed to a common real time clock in the controller upon disassembly. The tool combination can be run in the borehole as a separate operation or can be run in the well bore in as a separate operation with a pressure and temperature gauge as shown in FIG. 7.

The significance of the present invention is that each CPU of the respective tools is on a common real time basis which does not have to be disturb by assembly or disassembly. Further, the measurements of gamma rays, flow rates, pressure and temperature when taken in a borehole are synchronized to the same real time basis and are readily correctable for analysis.

It will be apparent to those skilled in the art that various changes may be made in the invention without departing from the spirit and scope thereof and therefore the invention is not limited by that which is disclosed in the drawings and specifications but only as indicated in the appended claims.

We claim:

1. Apparatus for digital communications between a tool electronic system contained in a well tool and a hand held controller electronic system with a two wire interconnection through a phone plug and phone jack, said apparatus including:

a well tool having a tool electronic system powered by a D.C. tool battery where the electronic system receives instruction data in digital form when operated at a communications voltage level above an operating voltage level of the tool battery for the tool electronic system;

a phone jack in said well tool, said phone jack having a closed contact switch connected between a terminal of the D.C. tool battery and the tool electronic system;

an independent hand held controller for communicating with the tool electronic system of said well tool, said controller having a controller electronic system including a switch means and a D.C. voltage regulator for providing a communications voltage level to said tool electronic system, said switch means being connected to a phone plug, said phone plug being cooperable with said phone jack for opening said closed contact switch in said phone jack and for connecting said controller electronic system to said tool electronic system and the D.C. tool battery so that the D.C. tool battery and the tool electronic system are connected through the phone plug to the controller electronic system, said switch means being operable for connecting the voltage regulator in the controller to said tool battery for establishing the communications voltage level in the tool electronic system for communicating data between said controller and said tool electronic system.

2. The apparatus as set forth in claim 1 wherein said controller electronic system further has a voltage meter for measuring the voltage of the D.C. tool battery when the phone jack is in the phone plug.

3. The apparatus as set forth in claim 1 wherein said well tool has collecting means for collecting measurement data where said collecting means is controlled by instruction means in the well tool, said controller electronic system and said tool electronic system respectively having voltage means for communicating digital signals representative of instruction data for the instruction means in the tool electronic system and having current means for communicating digital signals representative of measurement data in the tool electronic system, said voltage means and said current means being operative for communication when the communications voltage level is established.

4. The apparatus as set forth in claim 3 wherein said instruction means includes a real time clock and said controller has a real time clock, and means in said controller electronic system for setting the real time clock in said well tool with the real time clock in the controller.

5. A system for communicating an electronic system in a well tool with a hand held controller comprising:

a well tool having sensor means, said well tool having a tool CPU for providing operating instructions and a tool battery for providing electrical power and where the well tool is assembled for operation with the tool battery connected to the tool CPU and the sensor means connected to the tool CPU;

a hand held controller for communicating with said tool CPU after said tool is assembled, said controlled having a switch means and a controller CPU;

communications means including a two wire phone jack in said well tool with closed contacts for connecting said tool battery to an electrical ground of the well tool and a two wire phone plug for connecting said battery through said switch means to the electrical ground, said controller CPU being connected to said switch means, said phone plug connecting to said phone jack to open the closed contacts and to connect the switch means to the electrical ground of the well tool, said switch means being operable for connecting said controller CPU for communication with the tool CPU.

6. The apparatus as set forth in claim 5 further including a voltage meter in said controller connected to said switch means for determining the voltage of said tool battery.

7. The apparatus as set forth in claim 5 further including current signal generator in said well tool for output of data signals from said well tool and a voltage discriminator for receiving input of instruction data in digital form, said controller further having an adjustable voltage regulator for generating a communications voltage level for said current signal generator and for said voltage discriminator to enable communications with said current signal generator and said voltage discriminator.

8. The apparatus as set forth in claim 7 wherein the controller has a keyboard for input of instruction data to the tool CPU.

9. The apparatus as set forth in claim 8 wherein the controller has a liquid display screen for visual display of instruction data.

10. The apparatus as set forth in claim 7 wherein the controller has a memory card means cooperating with said controller CPU for the input and output of data.

11. Apparatus for a two way transfer of digital data with a two conductor wire system between a downhole well tool having a battery operated electronic means with a real time clock and an external hand held controller unit where said apparatus comprises:

a downhole well tool having a metal housing enclosing an electronic means, sensor means coupled to said electronic means where said sensor means derives electrical data signals representative of measurements of a downhole well bore parameter;

said electronic means including an I/O circuit, a real time clock, a tool CPU and a memory where said tool CPU and said memory are connected to said real time clock and to said I/O circuit means, said electronic means further having a battery pack to apply a D.C. operating voltage to said electronic means where said battery pack has a negative terminal, said tool CPU containing instruction data in digital form and said memory storing said data signals in digital form as a function correlated to time from said real time clock;

said downhole well tool further including a current signal generator for output of said data signals from said tool and a voltage discriminator for receiving input of instruction data in digital form from a controller unit;

a phone jack housing attached to said metal housing and comprising a phone jack having spring loaded contact members where one of said contact members is coupled to the metal housing for a primary electrical ground and the other of said contact members is connected to the negative terminal of said battery pack, said phone jack further having a socket connected to the metal housing for an alternate electrical ground;

a hand held controller unit having an adjustable voltage regulator for generating a communications voltage level for said electronic means for enabling said electronic means to receive input of instruction data and for output of data signals, said controller unit having a current sensing means for receiving such output data signals from said well tool, said adjustable voltage regulator and said current sensing means being connected to an electronic switch means;

said controller unit further having a controller CPU, a real time clock and a voltage meter, said voltage meter being connected between a phone plug and said switch means;

said phone plug having two conductors connected and arranged to make electrical contact with the socket in the phone jack housing and to make electrical contact with said contact members so as to connect the negative terminal or the tool battery through the switch means and the voltage meter to the alternate electrical ground of the metal housing while breaking the connection between said contact members to disconnect the negative terminal from the primary electrical ground so that said switch means initially connects said negative terminal of said battery pack through said switch means and said phone jack housing to the alternate electrical ground of said metal housing for maintaining the connection of the battery pack to the electronic means and for coupling the battery pack to the voltage meter; and said switch means being responsive to said controller CPU to connect said voltage regulator to the negative terminal for increasing the voltage level the tool CPU above the communication voltage level.

12. The apparatus as set forth in claim 11 wherein the D.C. power source in the said controller unit has a D.C. power source which consists of dry cell batteries and the controller unit has a keyboard for input of instruction data to the tool CPU.

13. The apparatus as set forth in claim 12 where said controller unit has a liquid crystal display screen for visual display instruction data, data from data signals and voltage.

14. The apparatus as set forth in claim 12 where said controller unit has a memory card means cooperating witch said controller CPU for the input and output of data.

15. The apparatus as set forth in claim 11 wherein controller CPU controls said switch means until said voltage meter provides an input signal to the controller CPU to control the voltage regulator for providing the preselected communications level of D.C. voltage which is greater than the level of voltage required for the tool CPU in the well tool to collect data.

16. Apparatus for synchronizing data input and output on a real time basis for a plurality of independently operated and battery powered downhole devices which sense and measure physical parameters and generate data signals representative thereof, and wherein said devices are carried in a downhole tool housing which include a readily detachable connector housing, said apparatus further comprising:

sensor means in said tool housing for generating data signals representative of physical parameters in a well bore, said tool housing having therein a tool D.C. battery as a voltage power source, an tool CPU means for collecting and processing data from said sensor means, memory means for storing data signals in a digital format, said sensor means being coupled for data transmission to said tool CPU means and to said memory means;

clock means for periodically coupling said tool battery to said tool CPU means and said memory means for periodically actuating to said tool CPU means, said memory means and said sensor means so that there are defined periods of time for collecting and for storing sample data signals in said memory means on a real time basis;

means for controlling the tool CPU means during said defined periods of time for applying said program instructions during each period of time to said memory means and to said sensor means for accessing the memory means and for collecting sample data signals from the sensor means during each such periods of time and for applying said collected sample data signals during each such period of time in a separate memory bank in the memory means;

transmission means in said tool housing for receiving digital signals representative of program instructions at a communication voltage level above an operating voltage level and for transmitting digital signals representative of the data signals in the memory bank at an operating voltage level above said communication level, said transmission means being a two conductor system;

a phone jack in said tool housing for accessing said transmission means, said phone jack being connected to the negative terminal of said D.C. battery and an electrical ground of the tool;

an independent hand held controller device having an a voltage/current communications circuit means which includes an voltage regulator for establishing a communication voltage level for the input of digital signals to the tool. CPU means in the tool housing, a current sensing circuit for detection of output digital data from the transmission means in the tool housing, and a controller CPU means, a clock means, a voltage measuring means and a switch means;

conductor means comprising a pair of wire leads connected at one end to said switch means;

a phone plug connected at the other end of said pair of wire leads and adapted for electrical connection with said phone jack when said connector housing is removed from said tool for connecting the negative terminal of said tool D.C. battery through the switch means to the voltage measuring means and to the electrical ground of the tool;

said controller CPU means being responsive to the voltage of said tool D.C. battery for adjusting the voltage regulator to a voltage above the predetermined communication voltage level for conducting communications between the controller CPU means and said tool CPU means;

said controller CPU means operating said switch means to connect the controller CPU means with said transmission means in said tool so that digital instructions and data are transmitted from the controller CPU to said tool CPU and recorded data are read out from the memory means and transmitted to said external controller CPU means for recording.

17. A method for digital communication between a well tool and hand held controller with the operative components of a well tool operated by a tool battery in the well tool, where a terminal of said tool battery in the well tool is connected to the operative components through a closed contact switch in a phone jack in a wall of the well tool housing and the phone jack has a socket connected to the operative components, and wherein the controller has a switch means connected by a two wire conductor to a phone plug, said method comprising the steps of:

connecting said phone plug to said phone jack for coupling said operative components to said tool battery through said socket and said switch means while opening said contact switch, determining the voltage of said tool battery, in the controller, increasing the voltage to the operative components of the well tool to a level above the normal battery supplied voltage to the well components for activating a communications system in the well tool to communicate with the controller.

18. The method as set forth in claim 17 further including the step of transmitting instruction data to the well tool from the controller in digital format and receiving stored data in the controller in digital format from the communications system in the well tool.

19. The method as set forth in claim 18 wherein the instruction data and the stored data are transmitted by respectively varying the voltage and by varying the current to define digital signals.

20. The method as set forth in claim 19 and further including the step of manually operating the controller to operate the communications system.

21. The method as set forth in claim 18 and further including the step of setting a clock in the operative components of the well tool to a real time value by instruction data from the controller.

* * * * *